US005836253A

United States Patent [19]

Kunka

[11] Patent Number: 5,836,253

[45] Date of Patent: Nov. 17, 1998

[54] NOISE-POWERED ELECTRICAL ACCESSORY CIRCUIT FOR MODEL RAILROAD

[76] Inventor: William B. Kunka, 2022 Michigan Blvd., Racine, Wis. 53402

[21] Appl. No.: 871,456

[22] Filed: Jun. 9, 1997

[51] Int. Cl.[6] ..... B60L 1/00

[52] U.S. Cl. ..... 104/296; 340/384.7; 446/410

[58] Field of Search ..... 104/53, 295, 296, 104/297; 246/34 R, 41, 43, 167 R, 218, 219, 256; 307/2; 340/384.1, 384.4, 384.7, 384.71; 446/410

[56] References Cited

U.S. PATENT DOCUMENTS

| | | | |
|---|---|---|---|
| 2,292,565 | 8/1942 | Jordon | 104/150 |
| 2,303,786 | 12/1942 | Bonanno | 104/150 |
| 2,521,240 | 9/1950 | Milne | 171/97 |
| 2,679,600 | 5/1954 | Bonanno | 307/2 |
| 2,708,885 | 5/1955 | Smith et al. | 104/150 |
| 2,791,972 | 5/1957 | Smith | 104/150 |
| 2,792,409 | 5/1957 | Smith | 104/150 |
| 2,826,996 | 3/1958 | Smith | 104/150 |
| 2,882,834 | 4/1959 | Smith | 104/296 |
| 2,905,102 | 9/1959 | Smith et al. | 104/297 |
| 2,990,964 | 7/1961 | Timmer et al. | 213/212 |
| 4,247,107 | 1/1981 | Smith et al. | 104/296 |
| 4,747,351 | 5/1988 | Baret | 340/384.71 |
| 5,174,216 | 12/1992 | Miller et al. | 104/296 |
| 5,555,815 | 9/1996 | Young et al. | 446/410 |
| 5,754,094 | 5/1998 | Frushour | 340/384.7 |

*Primary Examiner*—Mark Tuan Le

*Attorney, Agent, or Firm*—Jansson, Shupe, Bridge & Munger, Ltd.

[57] ABSTRACT

An electrical circuit for a model railroad includes a DC variable-voltage power source having a pair of output terminals connected to respective rails of a model railroad track. A capacitor and a normally-closed switch are connected in series across the output terminals. The improvement comprises an accessory circuit having first and second input lines, each connected to a separate one of the respective rails. The accessory circuit includes an AC-pass filter at the input lines and a rectifier section coupled to the AC-pass filter. A relay circuit is coupled to the rectifier section and includes an electrical contact switched between a first state, e.g., open, and a second state, e.g., closed. An electrically-powered accessory such as a whistle or horn is coupled to the contact and is energized when the contact switches from the first state to the second state.

13 Claims, 2 Drawing Sheets

NOISE-POWERED ELECTRICAL ACCESSORY CIRCUIT FOR MODEL RAILROAD

FIELD OF THE INVENTION

This invention relates generally to railroads and, more particularly, to a signalling circuit for a model railroad.

BACKGROUND OF THE INVENTION

Direct current (DC) model railroad systems are typically powered by an alternating current (AC) transformer having primary and secondary windings or having a single winding, the latter being known as an autotransformer. A pivoting handle or the like, manipulated by the operator of the model railroad system, changes the tap setting on the transformer and a variable AC voltage is thereby provided at the transformer output terminals.

Such AC voltage is directed to the input terminals of a full wave bridge rectifier and the output terminals of such rectifier provide a pulsating DC voltage. The magnitude of this DC voltage varies, depending upon the position of the pivoting handle or lever and, thus, upon the magnitude of the variable AC voltage available at the transformer.

The variable DC voltage is applied across two wires, one each connected to a separate rail of the model railroad system. The train engine includes two wheels, sliding shoes or the like which contact such rails, "pick up" the variable DC voltage and direct it to a small DC motor in the train engine. The system operator may thereby control the speed of the engine and the train by manipulating the position of the transformer handle.

Certain prior art patents describe that in a DC system, the output of the speed control circuit may include other than DC. For example, U.S. Pat. No. 2,303,786 (Bonanno) explains that the output of a full wave rectifier is direct current "admixed" with an alternating current of double frequency (i.e., two times line frequency), usually 120 cycles. The latter is used to hold a normally-closed whistle relay in the open position. A choke, capacitor and whistle control button are in series with one another and in parallel across the rectifier output. When the button is closed, the double-frequency voltage is short-circuited and the whistle relay closes and operates a whistle motor 24.

U.S. Pat. No. 2,990,964 (Timmer) discloses a train assembly having circuitry for uncoupling cars. The assembly uses a D.C. power unit, the output of which includes a low-voltage A.C. ripple. The ripple is short-circuited through a normally-closed switch and a capacitor. When the user desires to operate the coupler, the switch is opened, momentarily creating a signal current for coupler operation.

While earlier workers in the field of model railroad systems have recognized that DC power supplies often produce some sort of AC ripple, they have apparently not appreciated that random electrical "noise" or "hash" may also be present. Nor, apparently, has it been appreciated how this phenomenon may be used to operate an accessory circuit for powering an accessory such as a whistle, horn, flashing light or the like. An accessory circuit which uses electrical noise to power an accessory, which is sufficiently compact to mount in a model railroad engine or engine tender and which requires no auxiliary electrical pickup devices, e.g., wheels, sliding shoes or the like, would be a significant advance in the art.

OBJECTS OF THE INVENTION

It is an object of the invention to provide a noise-powered electrical accessory circuit for a model railroad system.

Another object of the invention is to provide an electrical accessory circuit which may be readily mounted in a model railroad engine or engine tender.

Another object of the invention is to provide an electrical accessory circuit suitable for powering a whistle or horn, the sound of which simulates those of an actual railroad engine.

Yet another object of the invention is to provide an electrical accessory circuit which, when mounted in a model railroad engine, requires no electrical pickup devices other than those used to power the DC motor in the engine. How these and other objects are accomplished will become apparent from the following descriptions and from the drawings.

SUMMARY OF THE INVENTION

The invention involves an electrical circuit for a model railroad. Such circuit includes (a) a DC variable-voltage power source having a pair of output terminals connected to respective rails of a model railroad track, and (b) a capacitor and a normally-closed switch connected in series across the output terminals.

The improvement comprises an accessory circuit having first and second input lines, each connected to a separate one of the respective rails. The accessory circuit includes an AC-pass filter at the input lines, i.e., a filter which permits the flow of AC current but which blocks DC current. A rectifier section is coupled to the AC-pass filter and a relay circuit is coupled to the rectifier section.

The relay circuit includes an electrical contact such as a relay having contacts switched between a first state and a second state. An electrically-powered accessory such as a whistle or horn is coupled to the contact. The accessory is energized when the contact switches from the first state to the second state. In an exemplary embodiment, the contact is open in the first state and is closed in the second state.

In a more specific aspect of the invention, the AC-pass filter includes at least one capacitor in series with the first input line and, most preferably, includes two capacitors, one each in series with the first and second input lines. The rectifier section includes a full wave bridge rectifier having first and second input terminals connected to the first and second input lines, respectively. Such rectifier has first and second output lines and the relay circuit includes a solid state switching device, e.g., a transistor, connected to such first and second output lines.

In a specific embodiment in which the solid state switching device is embodied as a transistor, a smoothing capacitor and a reverse-biasing resistor are connected in parallel between the first and second output lines. The switching device is switched to a conducting state when an AC noise signal is applied to the first output line. And when the switching device is switched to a conducting state, the electrical contact changes state.

The new accessory circuit is suitable for use in combination with an electrically-powered accessory coupled to the relay contact and energized when the contact switches from the first state to the second state. Such accessory circuit may be used with a horn or with a whistle mounted in a model railroad engine or in a model railroad engine tender, the latter sometimes referred to (in steam engine parlance) as a "coal car."

Other details of the invention are set forth in the following detailed description and in the drawings.

DETAILED DESCRIPTIONS OF PREFERRED EMBODIMENTS

Figure 1:
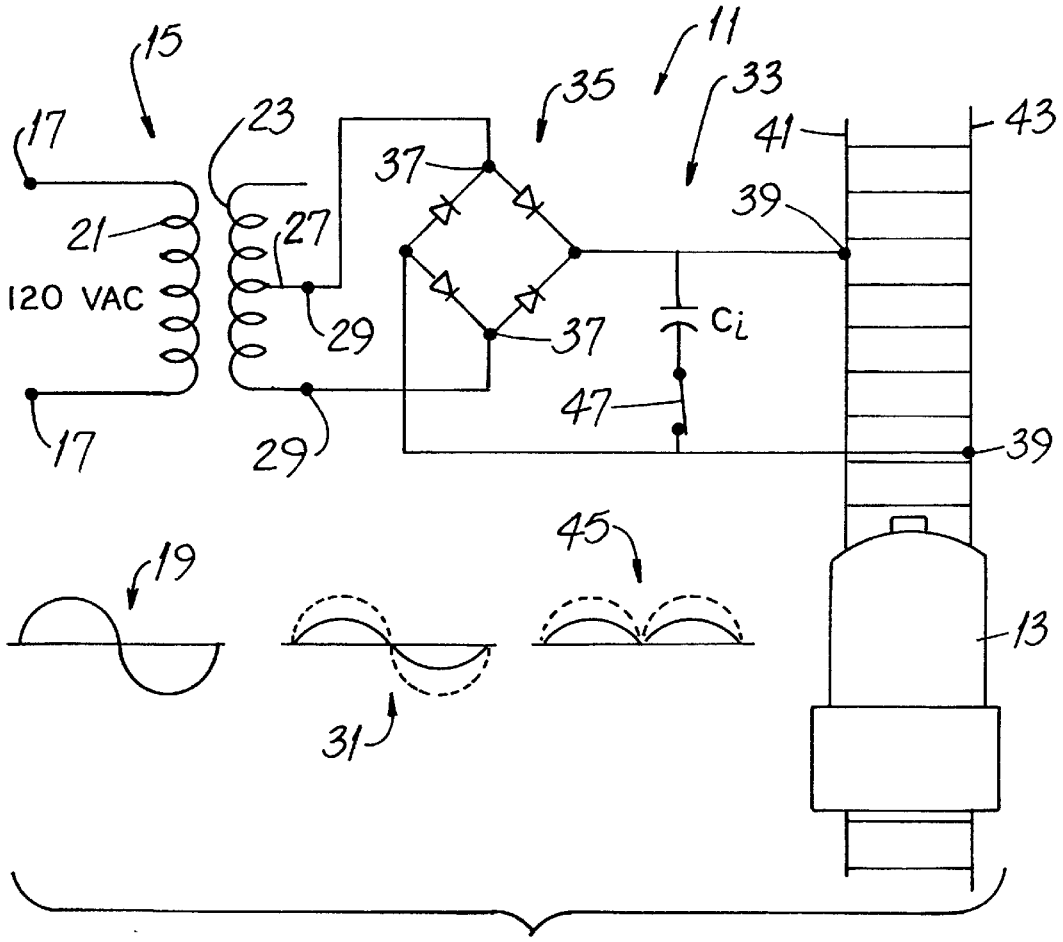
FIG. 1 PRIOR ART
FIG. 1 is a prior art electrical circuit useful in powering a model railroad engine equipped with a DC drive motor.
Figure 2:
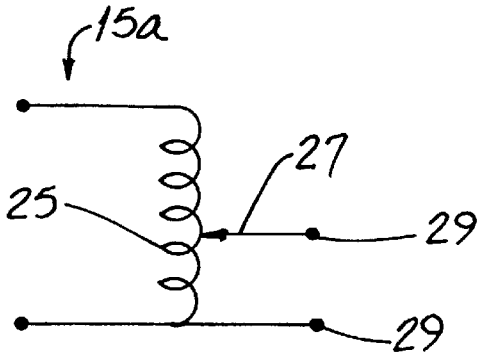
FIG. 2 is a symbolic diagram of an autotransformer.

Before describing the new accessory circuit 10, it will be helpful to have an understanding of a typical electrical circuit 11 useful in a model railroad system having a DC-powered engine 13. Referring first to FIGS. 1 and 2, the circuit 11 includes a transformer having a pair of input terminals 17 for 120 VAC, 50 Hz or 60 Hz, as available from, e.g., a residential wall outlet. A constant-voltage 120 VAC wave is represented by the symbol 19. The transformer 15 may be of the type having a primary winding 21 and a secondary winding 23 or it may be an autotransformer 15*a* as shown in FIG. 2 and having but a single winding 25.

The transformer 15, 15*a* includes a movable tap 27 coupled to a handle or lever (not shown) manipulated by the operator of the model railroad. Movement of the tap 27 changes the AC voltage available at the transformer output terminals 29. A variable-voltage AC wave is represented by the symbol 31.

Figure 3:
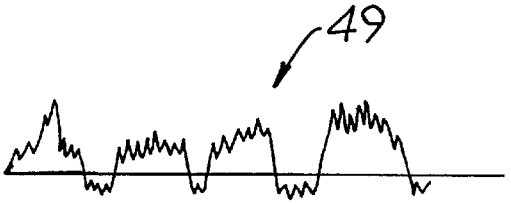
FIG. 3 is a symbol representing AC "noise" or "hash."

A DC variable-voltage power source 33 includes a full wave bridge rectifier 35, the input terminals 37 of which are connected to the transformer output terminals 29. The rectifier 35 has a pair of output terminals 39 connected to respective rails 41, 43 of a model railroad track. The variable DC voltage appearing across the terminals 39 is represented by the symbol 45. A capacitor Ci and a normally-closed switch 47 are in series with one another and are connected across the output terminals 39. When the motorized railroad engine 13 is being operated and the switch 47 is open, AC hash or noise, represented by the symbol 49 shown in FIG. 3, is present across the terminals 39. And when the switch 47 is closed, the capacitor Ci is connected across the terminals 39 and "smooths" the voltage available at the terminals 39. That is, the capacitor Ci substantially eliminates or at least dramatically reduces the AC noise without materially affecting the variable DC voltage represented by symbol 45. (The symbol 49 is intended to represent AC noise and that such noise may not be at 60 Hz and is likely to be characterized by a high degree of "randomness." And there is likely to be small "spikes" and valleys along the random wave.)

Figure 4:
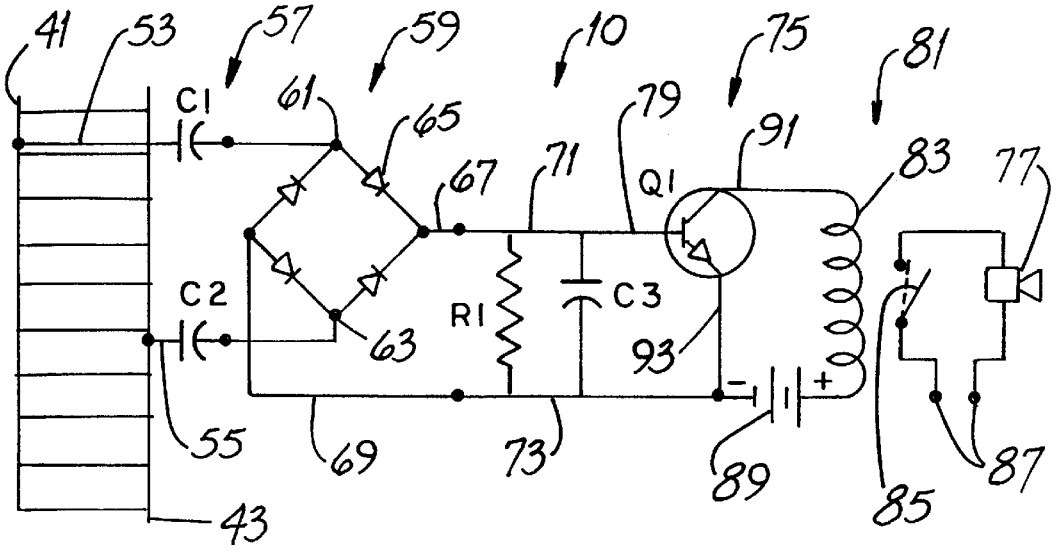
FIG. 4 is a schematic diagram of the inventive accessory circuit.

Referring next to FIG. 4, the new accessory circuit 10 has first and second input lines 53, 55 each having a terminal connected to a separate one of the respective rails 41, 43. The accessory circuit 10 includes an AC-pass filter 57 at the input lines 53, 55, i.e., a filter which permits the flow of AC current along the lines 53, 55 but which blocks DC current. A specific filter 57 is embodied as capacitors C1, C2, one in series with each of the lines 53, 55.

A rectifier section 59 has first and second input terminals 61, 63 coupled to the lines 53, 55 respectively, of the AC-pass filter 57 and such section 59 includes four diodes 65 connected to form a full wave bridge rectifier. The rectifier section 59 has first and second output lines 67, 69, respectively, which are coupled to the input lines 71, 73 of a DC-amplifying relay circuit 75 used to actuate an electrically-powered accessory 77 such as a whistle or horn.

The relay circuit 75 has a solid state switching device, e.g., a transistor Q1, connected to the rectifier output lines 67, 69, respectively. A smoothing capacitor C3 and a reverse-biasing resistor R1 are in parallel with one another and are connected between the first and second input lines 71, 73. The capacitor C3 smooths the DC output from the rectifier section 59 and the resistor R1 supplies reverse bias to the base 79 of the transistor Q1, both to help reduce spurious "turn-on" of the transistor Q1 and operation of the relay 81.

The relay circuit 75 includes an electromagnetic coil 83 or analogous component which switches the relay contact 85 between a normally-open first state, represented by the solid line, and a second or closed state represented by the dashed line. An electrically-powered accessory 77 such as a whistle or horn is coupled to the contact 85 through a power source connected at the terminals 87. Such power source may be, for example, the battery 89 or a similar, separate battery.

Referring to the FIGURES, in operation, it is first assumed that the engine 13 is being powered along the rails 41, 43 and that the switch 47 is closed. When such switch 47 is closed, the smoothing capacitor Ci reduces electrical noise across the terminals 39 to a level such that no appreciable noise is available at the lines 53, 55 of the accessory circuit 10. Under this condition, the transistor Q1 does not conduct and the contact 85 is open.

It is next assumed that the operator wishes to sound the whistle. To do so, the switch 47 is opened, the capacitor Ci is thereby removed from the circuit 11 and significant electrical noise appears across the terminals 39. Such noise flows along the rails 41, 43 to the input lines 53, 55 and the AC components of such noise pass through the filter 57 to the rectifier section 59. An electrical signal is thereby caused to occur on the output lines 67, 69 of the rectifier section 59 and on the input lines 53, 55 of the accessory circuit 10. Such signal "overpowers" the reverse bias provided by the resistor R1 and applies a forward bias signal to the base 79 of the transistor Q1.

The transistor Q1 is thereby switched to a conducting state and by virtue of the battery 89, electrical power flows in the loop comprising the transistor collector 91, emitter 93, battery 89 and relay coil 83. The relay coil 83 is energized and the contact 85 switches from the first or open state to the second, closed state, thereby energizing the accessory 77. And the accessory 77 is energized only so long as the switch 47 is held open.

Most preferably, an engine 13 is used with the circuit 10 since the presence of AC hash/noise is due in large part (if not entirely) to the presence of an inductive load across the tracks 41, 43, i.e., the engine drive motor. And satisfactory operation of the circuit 10 depends upon the presence of AC hash/noise rather than merely upon any AC ripple present at the terminals 39.

Figure 5:
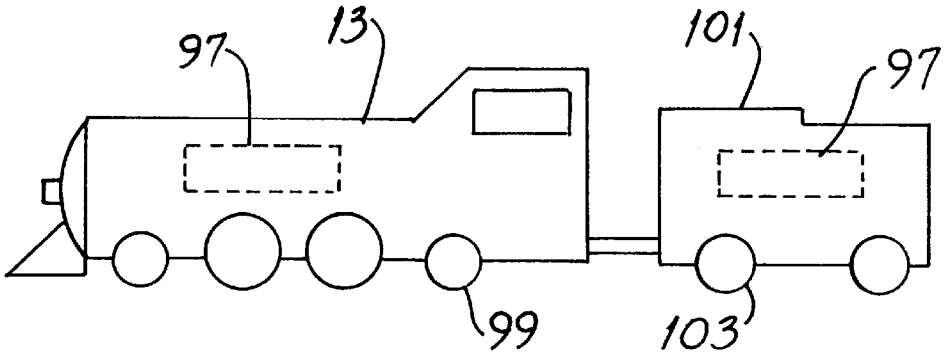
FIG. 5 is a pictorial representation of a model railroad engine and its tender.

Referring also to FIG. 5, the new accessory circuit 10, represented by the symbol 97, may be mounted in a model railroad engine 13 and the input lines 53, 55 connected to the power pickup wheels 99 on such engine 13. Or the new circuit 10 may be mounted in the engine tender 101 and the input lines 53, 55 connected to a pair of power pickup wheels 103 on the tender 101.

The following components have been found useful in making the circuits disclosed herein:

| | | | |
|---|---|---|---|
| $C_i$ | 2200 mf, 35VDC or more | C1, C2 | 10 mf |
| R1 | 3 Kohm | C3 | 47 mf |
| Q1 | 2N2222 | Battery | 6VDC |

While the principles of the invention have been shown and described in connection with a few preferred embodiments, it is to be understood clearly that such embodiments are by way of example and are not limiting.

What is claimed:

1. In an electrical circuit for a model railroad and including (a) a DC variable-voltage power source having a pair of output terminals connected to respective rails of a model railroad track, and (b) a capacitor and a normally-closed switch connected in series across the output terminals, the improvement comprising an accessory circuit having first and second input lines, each connected to a separate one of the respective rails, the accessory circuit including:

an AC-pass filter at the input lines;

a rectifier section coupled to the AC-pass filter;

a relay circuit coupled to the rectifier section, the relay circuit including an electrical contact switched between a first state and a second state; and an electrically-powered accessory coupled to the contact and energized when the contact switches from the first state to the second state.

2. The circuit of claim 1 wherein the AC-pass filter includes at least one capacitor in series with the first input line.

3. The circuit of claim 2 wherein the rectifier section includes a full wave bridge rectifier having first and second input terminals connected to the first and second input lines, respectively.

4. The circuit of claim 3 wherein the bridge rectifier has first and second output lines and the relay circuit includes a solid state switching device connected to the first and second output lines, the switching device being switched to a conducting state when an AC noise signal is applied to the first output line.

5. The circuit of claim 4 wherein the relay circuit further includes an electrical relay connected to the switching device and having the electrical contact.

6. An accessory circuit for a DC-powered model railroad system having first and second rails, the accessory circuit including:

first and second input lines for connection to the first and second rails, respectively:

first and second DC blocking capacitors in series with the first and second input lines, respectively;

a bridge rectifier connected to the DC blocking capacitors and having first and second output lines;

a smoothing capacitor connected between the first and second output lines; and a relay circuit connected to the first and second output lines, the relay circuit including an electrical contact switched between a first state and a second state.

7. The accessory circuit of claim 6 in combination with an electrically-powered accessory coupled to the contact and energized when the contact switches from the first state to the second state.

8. The combination of claim 7 wherein the accessory is a horn.

9. The combination of claim 8 in further combination with a model railroad engine.

10. The combination of claim 8 in further combination with a model railroad engine tender.

11. The combination of claim 7 wherein the accessory is a whistle.

12. The combination of claim 11 in further combination with a model railroad engine.

13. The combination of claim 11 in further combination with a model railroad engine tender.

* * * * *